US011076635B2

(12) United States Patent
Lisowski et al.

(10) Patent No.: US 11,076,635 B2
(45) Date of Patent: Aug. 3, 2021

(54) METHOD, MECHANISM AND APPARATUS FOR MOMENTARY COMPRESSION OF FILTER MATERIAL

(71) Applicant: International Tobacco Machinery Poland Sp. z o. o., Radom (PL)

(72) Inventors: Andrzej Lisowski, Radom (PL); Marcin Mamerski, Radom (PL); Robert Stanikowski, Radom (PL); Grzegorz Wiecaszek, Radom (PL)

(73) Assignee: International Tobacco Machinery Poland Sp. z o. o., Radom (PL)

( * ) Notice: Subject to any disclaimer, the term of this patent is extended or adjusted under 35 U.S.C. 154(b) by 248 days.

(21) Appl. No.: 16/362,379

(22) Filed: Mar. 22, 2019

(65) Prior Publication Data

US 2019/0281887 A1 Sep. 19, 2019

Related U.S. Application Data

(63) Continuation of application No. 14/168,023, filed on Jan. 30, 2014, now abandoned.

(30) Foreign Application Priority Data

Feb. 15, 2013 (PL) ..... 402777

(51) Int. Cl.
*A24D 3/02* (2006.01)

(52) U.S. Cl.
CPC ..... *A24D 3/0241* (2013.01); *A24D 3/0262* (2013.01); *A24D 3/0287* (2013.01)

(58) Field of Classification Search
CPC .. A24D 3/0241; A24D 3/0258; A24D 3/0262; A24D 3/0266; B30B 11/00; B30B 3/00
(Continued)

(56) References Cited

U.S. PATENT DOCUMENTS 2,796,810 A * 6/1957 Muller ..... A24D 3/0233 162/290
2,884,062 A * 4/1959 Taylor ..... D21J 7/00 162/415

(Continued)

FOREIGN PATENT DOCUMENTS

CH 504172 A 3/1971
DE 548860 C 4/1932

(Continued)

OTHER PUBLICATIONS

Ernst Voges, Tobacco Encyclopedia, 1984, pp. 421-429, published by TJI, Germany.

(Continued)

*Primary Examiner* — Dariush Seif
(74) *Attorney, Agent, or Firm* — Oppedahl Patent Law Firm LLC

(57) ABSTRACT

A mechanism for a momentary compression of a filter material used in the tobacco industry, wrapped into a wrapper and glued with an adhesive delivered from an adhesive applying apparatus, adapted to being placed on a machine for manufacturing filter rods before the adhesive applying apparatus is characterised in that it comprises at least one rotary compressing member for pressing the filter material linearly moving underneath it. A method of a momentary compression of a filter material used in the tobacco industry, wrapped into a wrapper and glued with an adhesive delivered from an adhesive applying apparatus on a machine for manufacturing filter rods is characterised in that before wrapping the filter material into the wrapper the filter material is compressed by exerting a force on the filter material by at least one rotary compressing member.

14 Claims, 5 Drawing Sheets

(58) Field of Classification Search
USPC ..... 493/42, 45, 46, 41, 50, 4, 27; 100/327, 100/155 R, 168, 153; 492/27; 156/165, 156/391; 131/58, 60, 64.1, 64.2
See application file for complete search history.

(56) References Cited

U.S. PATENT DOCUMENTS 2,918,922 A * 12/1959 Eissmann ..... A24C 5/1814 131/339
3,018,731 A 1/1962 Eissmann
3,018,781 A * 1/1962 Eissmann ..... A24C 5/18 131/64.1
3,040,752 A * 6/1962 Ganz ..... A24D 3/04 131/331
3,170,467 A * 2/1965 Di Giacomo ..... A24C 5/18 131/66.1
3,482,488 A 12/1969 Sexstone
3,529,603 A * 9/1970 Berkeley ..... A24C 3/00 131/61.1
3,583,406 A * 6/1971 Soyars ..... A24C 5/605 131/79
3,610,112 A * 10/1971 Labbe ..... A24D 3/0225 131/61.1
3,624,722 A * 11/1971 Stone ..... A24D 3/0233 493/42
3,646,855 A * 3/1972 Muller ..... A24D 3/0204 493/43
3,716,443 A 2/1973 Preston
3,762,281 A 10/1973 Boegli et al.
3,772,967 A 11/1973 Burrus et al.
3,813,996 A * 6/1974 Labbe ..... A24D 3/0233 493/44
3,888,160 A 6/1975 Westcott
3,911,797 A * 10/1975 Kastner ..... A24C 5/465 493/45
3,974,750 A * 8/1976 Frank ..... A24D 3/025 493/39
4,040,341 A * 8/1977 Molins ..... A24D 3/0287 493/39
4,115,275 A * 9/1978 Morris ..... B01D 33/04 210/386
4,196,740 A * 4/1980 Rudszinat ..... A24C 5/34 131/84.2
4,219,033 A * 8/1980 Horsewell ..... A24D 3/043 131/339
4,287,979 A 9/1981 Molins et al.
4,411,280 A * 10/1983 Floyd ..... A24D 3/0237 131/332
4,548,215 A * 10/1985 Adebahr ..... A24C 5/1871 131/84.1
4,593,706 A * 6/1986 Preston ..... A24C 5/39 131/109.1
4,701,240 A * 10/1987 Kraemer ..... B30B 1/003 100/155 G
4,730,628 A * 3/1988 Townsend ..... A24D 1/00 131/364
4,791,943 A * 12/1988 Kupper ..... A24D 3/04 131/339
4,803,877 A * 2/1989 Yano ..... B65H 20/02 100/162 B
4,832,057 A * 5/1989 Bale ..... A24C 5/40 131/329
5,024,241 A * 6/1991 Hulsman ..... A24D 1/00 131/84.2
5,141,000 A * 8/1992 Ruppert ..... A24C 5/40 131/360
5,167,241 A * 12/1992 Ruppert ..... A24C 5/40 131/70
6,062,228 A * 5/2000 Loercks ..... A24D 3/08 131/332
6,067,995 A * 5/2000 Schneider ..... A24D 1/00 131/360
6,656,412 B2 * 12/2003 Ercelebi ..... A24D 3/0225 264/112
7,762,267 B2 * 7/2010 Schmidt ..... A24D 3/066 131/339
8,616,257 B2 * 12/2013 Mori ..... B32B 17/10036 156/391
8,662,088 B2 3/2014 Owczarek
8,869,969 B2 10/2014 Cie likowski et al.
8,925,708 B2 1/2015 Cie likowski et al.
8,967,370 B2 3/2015 Cieslikowski
9,004,261 B2 4/2015 Cie likowski et al.
9,061,835 B2 6/2015 Gielniewski
9,161,571 B2 10/2015 Sikora
9,622,510 B2 4/2017 Mamerski
9,827,596 B2 11/2017 Cieslikowski et al.
2003/0224918 A1 * 12/2003 Lanier, Jr. ..... A24D 3/022 493/39
2005/0070409 A1 * 3/2005 Deal ..... A24D 3/0216 493/44
2005/0161358 A1 * 7/2005 Kern ..... B31C 13/00 206/388
2006/0011205 A1 * 1/2006 Adiga ..... A24D 1/00 131/334
2006/0112963 A1 * 6/2006 Scott ..... A24D 3/0287 131/331
2007/0240726 A1 * 10/2007 Sendo ..... A24D 1/002 131/62
2009/0036284 A1 * 2/2009 Spiers ..... A24D 3/0225 493/47
2011/0190105 A1 * 8/2011 Fallon ..... A24D 3/0212 493/39
2011/0314886 A1 * 12/2011 Sato ..... B21D 5/083 72/127
2012/0080043 A1 * 4/2012 Naenen ..... A24D 3/0216 131/341
2012/0220438 A1 * 8/2012 Herholdt ..... A24D 3/0216 493/39
2013/0087056 A1 4/2013 Chojnacki
2013/0199551 A1 * 8/2013 Le Roux ..... A24C 5/10 131/284
2014/0011652 A1 1/2014 Cieslikowski et al.
2014/0097107 A1 4/2014 Zagajska
2014/0123826 A1 5/2014 Cieslikowski et al.
2014/0158252 A1 6/2014 Owczarek
2014/0196728 A1 * 7/2014 Lisan ..... A24D 3/0233 131/275
2014/0224268 A1 * 8/2014 Ryter ..... A23L 27/72 131/332
2015/0013519 A1 1/2015 Cieslikowski et al.
2015/0020819 A1 * 1/2015 Barrett ..... A24D 3/067 131/191
2015/0047137 A1 2/2015 Gielniewski
2015/0068376 A1 3/2015 Boleslawski
2015/0114543 A1 4/2015 Riedel
2015/0114988 A1 4/2015 Riedel
2015/0164133 A1 * 6/2015 Davis ..... A24D 3/025 131/332
2015/0342247 A1 12/2015 Ugrewicz
2016/0000142 A1 1/2016 Stanikowski et al.
2016/0103076 A1 4/2016 Mamerski et al.
2016/0120215 A1 5/2016 Cieslikowski et al.
2016/0143350 A1 5/2016 Figarski et al.
2016/0150818 A1 * 6/2016 Deal ..... A24D 3/0216 493/42

FOREIGN PATENT DOCUMENTS

DE 1901120 A1 7/1968
DE 2100982 A1 6/1972
DE 2138949 A1 2/1973
DE 2065727 A1 4/1975
DE 2540650 A1 3/1977
DE 2732959 A1 1/1978
EP 0232166 A2 8/1987
EP 0674849 A1 10/1995
EP 1101415 A1 5/2001
EP 1464241 A1 10/2004

(56) References Cited

FOREIGN PATENT DOCUMENTS

| | | | |
|---|---|---|---|
| EP | 2057908 | A1 | 5/2009 |
| EP | 2210509 | A1 | 7/2010 |
| EP | 2767177 | B1 | 9/2015 |
| EP | 3024341 | B1 | 9/2017 |
| GB | 1095190 | A | 12/1967 |
| GB | 1112294 | A | 5/1968 |
| GB | 1183498 | A2 | 3/1970 |
| GB | 1261448 | A | 1/1972 |
| GB | 1346536 | A | 2/1974 |
| GB | 1556189 | A | 11/1979 |
| WO | 0158565 | A2 | 8/2001 |
| WO | 2012069114 | A2 | 5/2012 |
| WO | WO 2013004994 | A1 | 1/2013 |

OTHER PUBLICATIONS

European Search Report in application 14153194, dated Jun. 12, 2014.

Japanese Office Action dated Jun. 26, 2015 Patent Application No. 2014-026396.

Polish search report dated Jun. 11, 2013 in Polish priority patent application No. P.402777.

* cited by examiner

METHOD, MECHANISM AND APPARATUS FOR MOMENTARY COMPRESSION OF FILTER MATERIAL

What is described is a method, a mechanism and an apparatus for a momentary compression of a filter material used to manufacture tobacco industry products.

BACKGROUND

In the tobacco industry, cigarettes provided with filters are manufactured, whereas the filters can be made of one kind of material or can be composed of multiple materials having different physical and filtering characteristics. The filter material in a continuous form, for example acetate, is cut into rods and applied to the cigarettes. In addition, filters manufactured of several concentrically arranged filter material layers are known. Filters having several segments of different materials are more and more frequently used in the cigarettes manufactured in present times. Machines for manufacturing multi-segment filter rods of continuous multi-segment filter rods are known in the prior art. Such machines combine the segments delivered from multiple feeding devices, whereas the segments are formed by cutting filter rods transferred for example on a drum conveyor using a cutting head provided with rotary knives. Individual segments are combined, depending on the apparatus, next to one another on a drum conveyor or one after another on a linear conveyor in order to finally form a linearly moving continuous multi-segment rod being cut into individual multi-segment rods. At the further stages of the cigarette manufacturing process the multi-segment rods are cut into individual multi-segment filters applied to individual cigarettes.

A very significant aspect of the production of filter rods of different known kinds is the quality of segment wrapping with a wrapper. The quality is determined by both the deformation of the wrapper in the region of an adhesive seam and the filling of the wrapper with the filter material.

Members for compression in the form of immovable pressing bars which heat up during the operation and lead to material damage are known in the prior art. The U.S. Pat. No. 3,716,443 disclosed an apparatus for manufacturing filter rods of a continuous filter material wherein a member for forming an endless filter rod was used, whereas such member is cooled by means of compressed air. Due to the use of compressed air a thin layer reducing the friction between the filter material and the guiding members is formed.

It would thus be helpful if an improved mechanism, apparatus and a method could be developed for compression of the filter material.

SUMMARY OF THE INVENTION

The gist of the invention is a method of a momentary compression of the filter material used in the tobacco industry, wrapped into a wrapper glued with an adhesive delivered from an adhesive applying apparatus. A method is characterised in that before wrapping the filter material into a wrapper the filter material is compressed by exerting a force on the material by means of at least one rotary compressing member.

A method according to the invention is characterised in that the filter material is gradually compressed by means of a set of multiple rotary compressing members acting on the material being compressed with a different force.

A method according to the invention characterised in that the force exerted by successive rotary compressing members on the filter material is increasing.

A method according to the invention characterised in that the force exerted on the filter material is directed in a vertical direction.

A method according to the invention characterised in that the force exerted on the filter material is directed at an angle to the vertical direction.

The gist of the invention is also a mechanism for a momentary compression of the filter material used in the tobacco industry, wrapped into a wrapper glued with an adhesive delivered from an adhesive applying apparatus, adapted to being placed on a filter rod manufacturing machine before the adhesive applying apparatus. The said mechanism is characterised in that it comprises at least one rotary compressing member for pressing the filter material linearly moving underneath it.

Furthermore, a mechanism according to the invention is characterised in that it comprises two rotary compressing members.

A mechanism according to the invention is characterised in that it comprises three rotary compressing members.

A mechanism according to the invention is characterised in that the last rotary compressing member, counting in the direction of movement of the filter material, has a smaller working width than the preceding compressing members.

A mechanism according to the invention is characterised in that it is adapted to the adjustment of position of the rotary compressing members in at least one axis, preferably in all axes.

A mechanism according to the invention is characterised in that it is adapted to the adjustment of the angle between an axis of the linear movement of the filter material and a line of compression of the compressing mechanism, in particular the line determined by the centres of rotation of the rotary compressing members.

A mechanism according to the invention is characterised in that the rotary compressing member is a compressing roller with a cylindrical working surface.

A mechanism according to the invention is characterised in that the rotary compressing member is a compressing roller with a conical working surface.

A mechanism according to the invention is characterised in that the rotary compressing member is a compressing roller with an oval working surface.

Furthermore, the substance of the invention is an apparatus for manufacturing filter rods of a filter material used in the tobacco industry. An apparatus is characterised in that it comprises at least one compressing mechanism according to the invention.

An advantage of the method and the apparatus according to the invention is an effective operation with a low-cost and simple embodiment of the solution according to the invention. The solution according to the invention is, in addition, free of drawbacks of solutions known in the prior art, i.e. it does not heat up during the operation, and it does not cause material damage either. The compressing members roll on the surface of the filter material differently from the solutions known in the prior art where the effect of sliding of the pressing bars on the filter material occurred.

DESCRIPTION OF THE DRAWING

The invention is explained in a drawing in which.

DETAILED DESCRIPTION

Figure 1:
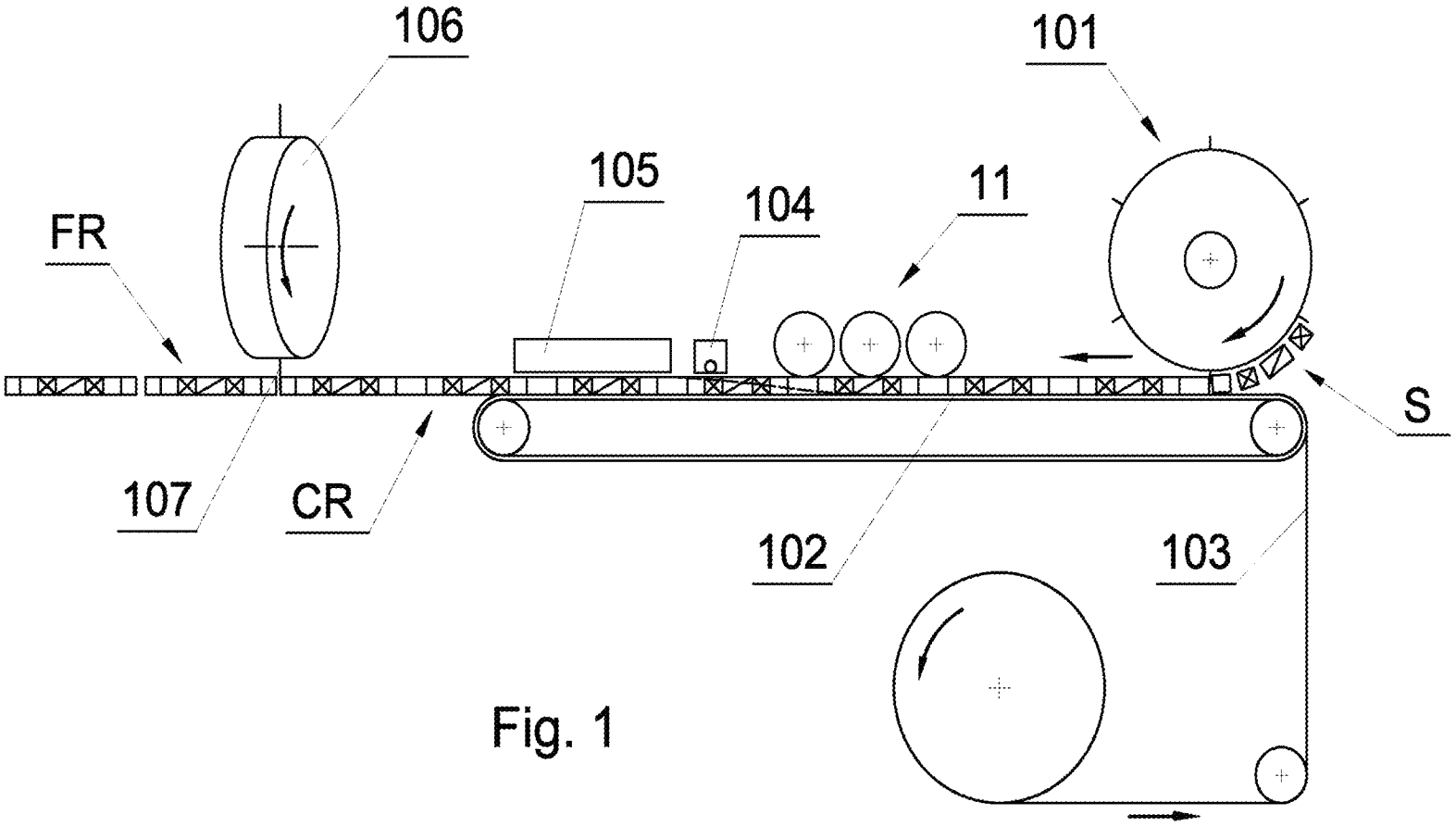
FIG. 1 diagrammatically shows a fragment of a machine for manufacturing multi-segment rods.

FIG. 1 diagrammatically shows a fragment of a machine for manufacturing multi-segment rods. A delivery unit 101 delivers filter segments S prepared in a known way onto a conveyor 102, whereas onto its surface a wrapper 103 is placed. During the transfer of segments on the conveyor 102 the wrapper 103 is wrapped in a known way around the segments and glued, whereas the adhesive is delivered from an adhesive applying apparatus 104 and an adhesive seam is heated up by a heater 105. A multi-segment continuous rod CR formed in such a way is transferred further and is cut into filter rods FR by means of a known cutting head 106 provided with knives 107. Typical members supporting and guiding the endless rod CR and the filter rods FR were omitted in the drawing.

An apparatus for a momentary compression of the filter material constitutes a part of a machine for manufacturing rods of the filter material. It comprises members for guiding the wrapper and the filter material, and a compressing mechanism 11 a fragment of which was shown in FIG. 2. The compressing mechanism 11 is situated above the moving filter material, for example in the form of segments S, whereas the wrapper into which the segments are wrapped was not shown. An example mechanism comprises three rotary compressing members 10 situated one after another, whereas in the embodiment shown the centres of the compressing members 10 lying on the axes of rotation T of the compressing members are situated on one line 12. Through the lowest positioned points, which press the material to the highest degree, a compression line 13 on the circumferential surfaces of the rotary members 10 was drawn. For the rotary members 10 with equal diameters the compression line 13 will be parallel to a line 12 going through the centres of the rotary members 10. The rotary members 10 can have different diameters, whereas the compression line defined by the lowest positioned points can be inclined relative to the axis SA of the filter material S at an angle $\alpha$ between 1° and 5°, preferably the inclination is between 2° and 3° depending on the filter material. An inclination of the compression line ensures that successive rotary compressing members 10 act on the filter material with an increased force. If different diameters of the rotary members 10 are used, the compression line 13 is a broken line.

Figure 3:
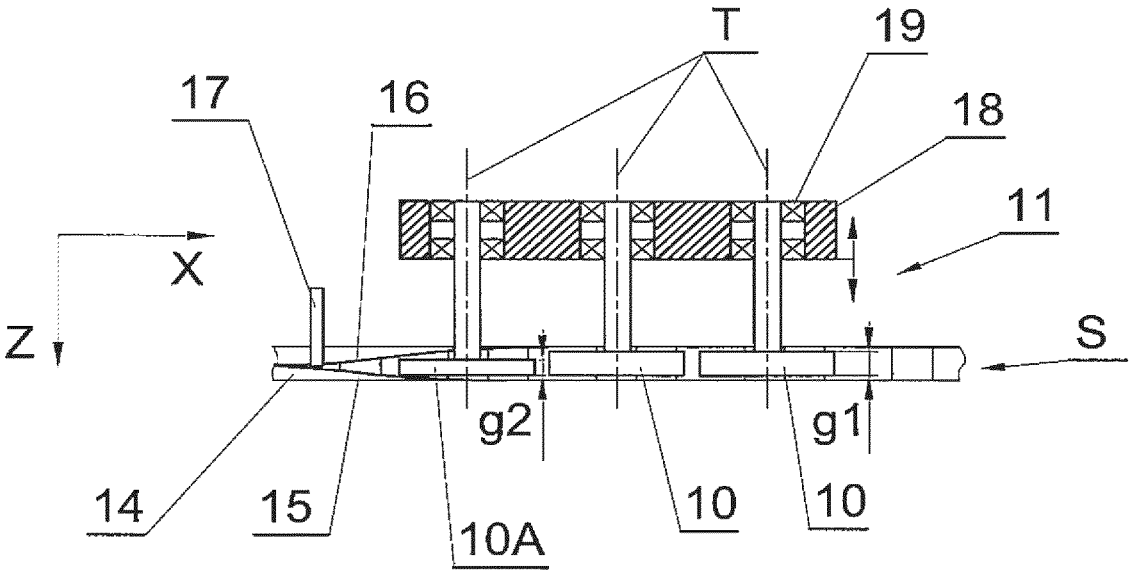
FIG. 3 shows a compressing mechanism in a top view.

FIG. 3 shows a compressing mechanism 11 for a momentary compression of the filter material in a top view. A wrapper 14 into which the segments S are wrapped can be seen here, whereas its edges were marked with the markings 15 and 16. Also an adhesive nozzle 17 of an adhesive applying apparatus, from which the adhesive is delivered onto the wrapper 14 on the edge 15, is shown in simplified representation. Three rotary compressing members 10 can be seen in the compressing mechanism 11 shown, whereas the last rotary compressing member 10A has a smaller width g2 than a width g1 of the preceding compressing members 10. The rotary compressing members 10, 10A are rotatably mounted in a body 18 by means of bearings 19. The rotary compressing members are set in rotational motion by the filter material. A torque coming from the forces of friction between the filter material and the surface of compressing members acts on each of the compressing members. However, a solution is also possible wherein they are driven by a separate drive mechanically or electronically synchronised with the drive of the conveyor 102 (FIG. 1) so that no slide between the circumferential surface of the rotary members 10 and the surface of the filter material S occurs.

Figure 4:
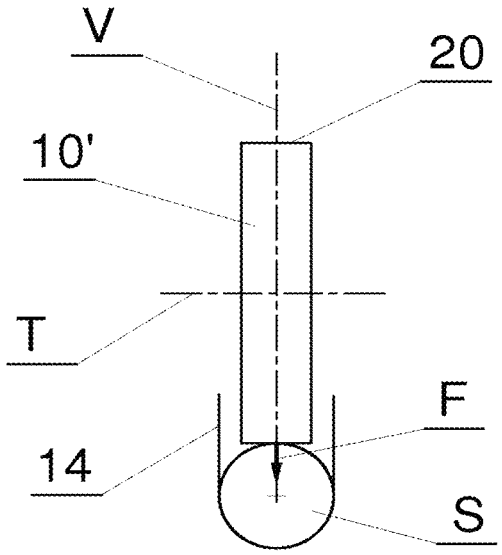
FIG. 4 shows an embodiment of a rotary compressing member.
Figure 5:
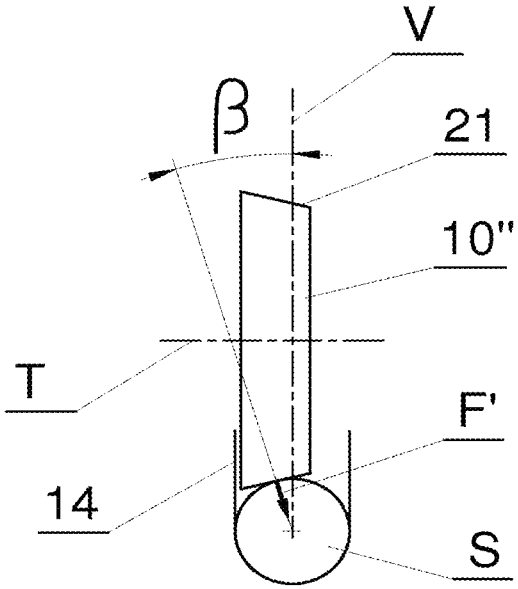
FIG. 5 shows another embodiment of a rotary compressing member.
Figure 6:
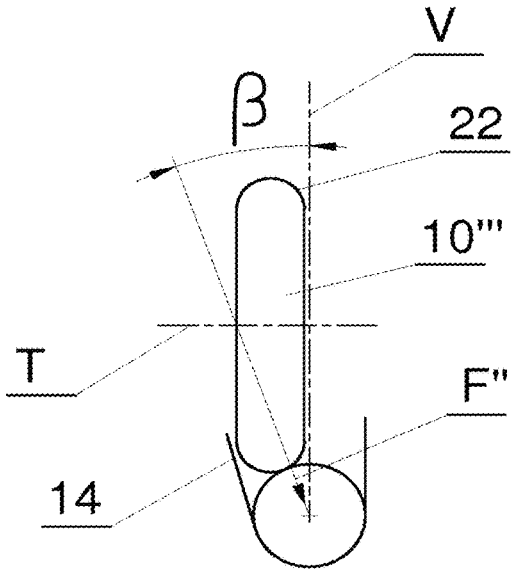
FIG. 6 shows another embodiment of a rotary compressing member.

The embodiments of rotary compressing members are described below. A rotary compressing member 10' rotating around the axis T shown in FIG. 4 has a circumferential surface 20 in the cylindrical form and during the operation of the mechanism exerts a force F on a continuous or segmental filter material S partly wrapped into the wrapper 14, whereas the force F is directed in a vertical direction V and causes horizontal depression of the filter material. The rotary compressing member 10" rotating around the axis T shown in FIG. 5 has a circumferential surface 21 in the conical form and during the operation exerts a force F' on the continuous or segmental filter material S partly wrapped into the wrapper 14, whereas the force F' is directed at an angle $\beta$ to the vertical direction V and causes inclined depression on the surface of the filter material. Preferably the angle $\beta$ is between 5° and 30°. Conducted tests showed that even more preferably the angle $\beta$ amounts between 15° and 20°. A rotary compressing member 10''' rotating around the axis T shown in FIG. 6 has an oval circumferential surface 22 and during the operation exerts a force F" on a continuous or segmental filter material S partly wrapped into the wrapper 14, whereas the force F" is directed at an angle $\beta$ to the vertical direction V and causes inclined concave depression of the filter material.

Figure 2:
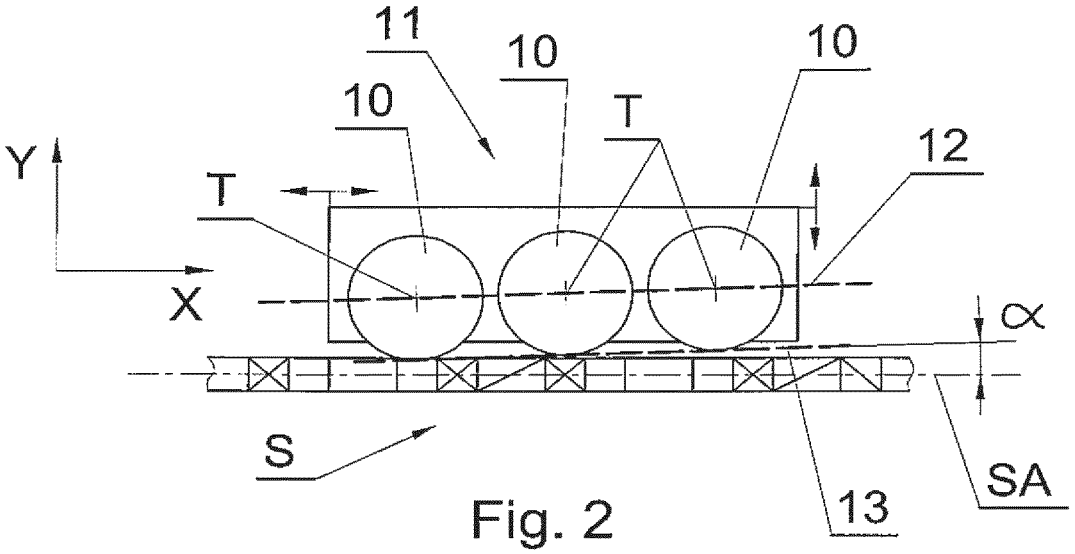
FIG. 2 shows a compressing mechanism in a front view.

The position of the compressing mechanism can be selected according to the filter material and the manufacturer's requirements. The position of the compressing mechanism can be determined in a typical way in the directions of three axes X, Y and Z (FIGS. 2 and 3). In addition, the angular position of the compressing mechanism can be determined so as to select the value of the angle $\alpha$ of the compression line of the mechanism relative to the axis of the filter material according to the kind of the filter material.

Figure 7:
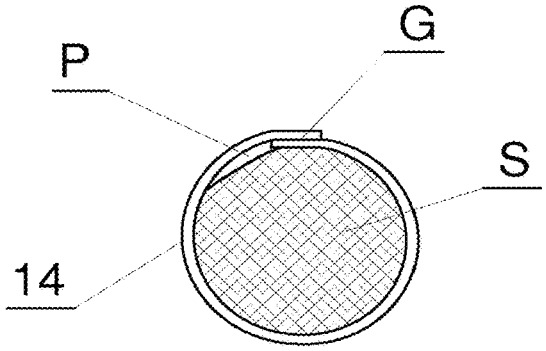
FIG. 7 shows a section of a continuous filter rod during material decompression.
Figure 8:
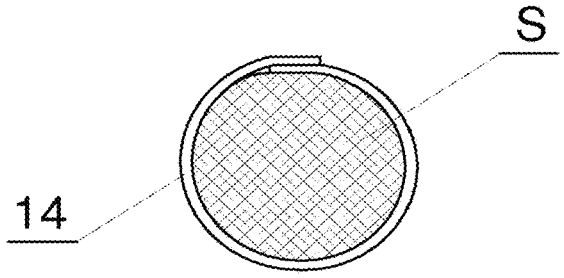
FIG. 8 shows a section of a continuous filter rod after material decompression.

During the manufacture of filter rods FR, before gluing the wrapper 14, the filter material S in the form of segments or in the continuous form is compressed by means of the compressing mechanism 11 in order to reduce the cross-section of the filter material. The depression and the reduction of the cross-section caused by the compression makes it possible that wrapping of the wrapper in order to obtain a cylindrical sleeve around the filter material takes place without the need of a simultaneous compression of the wrapped material. The wrapper is formed in the cylindrical shape and is glued. A decompression takes place during the wrapping and it finally ends after forming a sleeve of the wrapper. FIG. 7 shows a section of an endless filter rod during the decompression of the filter material S; a certain space P not yet filled with the filter material exists within the endless rod section, whereas the wrapper has already been formed, and the adhesive seam G has already been made. FIG. 8 shows a section of an endless filter rod after the decompression of the filter material S.

Figure 9:
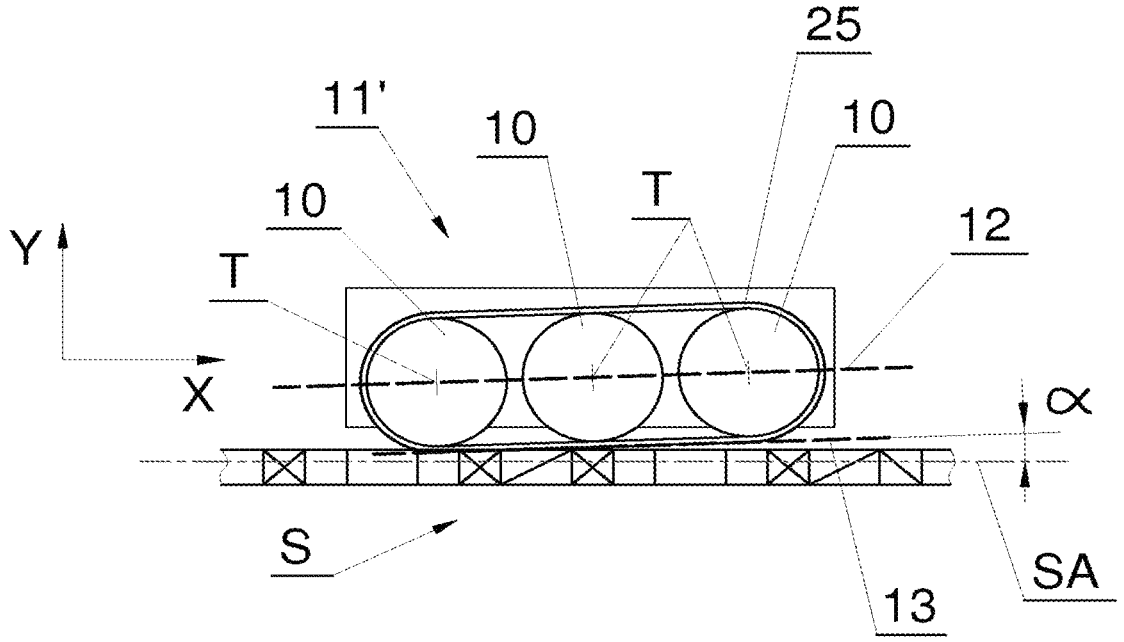
FIG. 9 shows an alternative embodiment of the compressing mechanism.

A compressing mechanism 11' according to the invention can also be embodied using an intermediate pressing member 25 (FIG. 9) between the rotary compressing members 10 and the filter material S, for example in the form of a strip or a tape. The working surface of the intermediate pressing member 25 can be shaped in any way. The use of an intermediate pressing member does not influence the effectiveness of operation of the mechanism according to the invention.

An advantage of the method according to the invention is that the final decompression of the filter material takes place after forming and gluing the wrapper, which allows obtaining better filling of the wrapper.

The invention claimed is:

1. A method for wrapping preformed rod-shaped filter segments (S) used in the tobacco industry into a wrapper, wherein the preformed rod-shaped filter segments (S) positioned on the wrapper (103) are travelling on a belt of a conveyor (102), the wrapper (103) being located lengthwise on the conveyor (102), the method characterized by the following steps:

forming the wrapper (14) into a U-shape, momentarily compressing the preformed rod-shaped filter segments (S) by means of at least one rotary compressing member (10) exerting a force (F) on the preformed rod-shaped filter segments (S) located in the U-shaped wrapper (14), the U-shaped wrapper having an edge, wherein the at least one rotary compressing member (10) is situated above the travelling preformed rod-shaped filter segments (S) and the force (F) is directed in a vertical direction (V) or at an angle (β) relative to the vertical direction (V), forming the U-shaped wrapper (14) into a cylindrical sleeve around the compressed preformed rod-shaped filter segments (S) by delivering glue from an adhesive applying apparatus on the edge (15) of the U-shaped wrapper (14), yielding a fully closed cylindrical wrapper, allowing the compression of the preformed rod-shaped filter segments (S) to cease after the fully closed cylindrical wrapper has been formed, such that space inside the fully closed cylindrical wrapper (14) is filled with at least one preformed rod-shaped filter segment (S).

2. The method as in claim 1 wherein the compression of each preformed rod-shaped filter segment (S) is carried out gradually by means of a series of multiple rotary compressing members (10), each of the multiple rotary compressing members acting on the compressed preformed rod-shaped filter segment (S) with a different force (F).

3. The method as in claim 2 wherein the force (F) exerted by successive rotary compressing members (10) on the compressed rod-shaped filter segment (S) increases.

4. The method as in claim 1 wherein the force (F) is directed at an angle (β) in the range of 5° to and 30°.

5. The method as in claim 4 wherein the angle (β) is in the range of 15° to 20°.

6. A device for wrapping a preformed rod-shaped filter segment (S) used in the tobacco industry into a wrapper, comprising:

a belt conveyor (102) for transferring the preformed rod-shaped filter segments (S) positioned on the wrapper (103), wherein the wrapper (103) is formed into a U-shaped wrapper (14), an adhesive applying apparatus (104) for delivering glue on the edge of the U-shaped wrapper (14), a heater (105) adapted to heat up adhesive so that fully closed cylindrical sleeve of the wrapper (14) is formed, and a momentary compressing mechanism (11, 11') arranged before the adhesive applying apparatus (104) and comprising at least one rotary compressing member (10) excreting a force (F) on the preformed rod-shaped filter segment (S) located in the U-shaped wrapper (14), wherein rotary compressing member (10) is situated above the travelling preformed rod-shaped filter segment (S) and wherein the momentarily compressing mechanism (11, 11') is adapted to adjust the force (F) so that the force (F) is directed in a vertical direction V or at an angle βrelative to the vertical direction V to allow decompression of the preformed rod-shaped filter segment (S) to end to end after forming the cylindrical sleeve of the wrapper (14).

7. The device as in claim 6, wherein it comprises two rotary compressing members (10).

8. The device as in claim 7 wherein the last rotary compressing member (10A), considering the direction of movement of the preformed rod-shaped filter segments (S), has a smaller working width than the preceding compressing members (10).

9. The device as in claim 6, wherein it comprises three rotary compressing members (10).

10. The device as in claim 6 wherein rotary compressing members (10) have different diameters and a compression line (13) defined by the lowest points of rotary compressing members (10) is inclined relative to an axis (SA) of the preformed rod-shaped filter segment (S) an angle (α) between 1° and 5°.

11. The device as in claim 10 wherein the inclination is between 2° and 3°.

12. The device as in claim 6 wherein the rotary compressing member (10) is a compressing roller with a cylindrical working surface (20).

13. The device as in claim 6 wherein the rotary compressing member (10) is a compressing roller with a conical working surface (20).

14. The device as in claim 6 wherein the rotary compressing member (10) is a compressing roller with an oval working surface (20).

* * * * *